United States Patent [19]

Wanner

[11] Patent Number: 4,831,911

[45] Date of Patent: May 23, 1989

[54] WIND INSTRUMENT HAVING A COMPACT SLIDE CONFIGURATION

[76] Inventor: John H. Wanner, 4833 West Washington, Las Vegas, Nev. 89107

[21] Appl. No.: 314,978

[22] Filed: Oct. 26, 1981

[51] Int. Cl.[4] ..... G10D 7/10

[52] U.S. Cl. ..... 84/395

[58] Field of Search ..... 84/395–397

[56] References Cited

U.S. PATENT DOCUMENTS 673,983 5/1901 Harrison ..... 84/395

1,255,766 2/1918 Martens ..... 84/395

2,093,993 9/1937 Adriani ..... 84/395

*Primary Examiner*—Lawrence R. Franklin

*Attorney, Agent, or Firm*—Sachs & Sachs

[57] ABSTRACT

A brass wind instrument incorporating a compact slide configuration comprising two U-shaped slide tube members, each having two tube lengths which are proximate to each other and which are coupled together with a minimum length crook. The two U-shaped slide tube members, in the preferred embodiment, are in parallel planes and are permitted to reciprocate, during use, on four corresponding fixed length receiver tube members.

34 Claims, 2 Drawing Sheets

WIND INSTRUMENT HAVING A COMPACT SLIDE CONFIGURATION

BACKGROUND AND/OR ENVIRONMENT OF THE INVENTION

1. Field of the Invention

The present invention relates to wind instruments, and more particularly to slides for trombones or other brass wind instruments which achieve pitch changes by variably positioning the slide along cooperating fixed length receiver tube members.

2. Description of the Prior and/or Contemporaneous Art

Of all the brass wind instruments, the slide trombone is one of the most unique. The basic concept of varying the length of instrument tubing through which vibrated air passes to vary the pitch of the resulting sound is common to most brass wind instruments. This effect is usually achieved, in instruments other than trombones, by finger actuated valves which help to selectively form and interpose differently lengthed tubular segments into the flow path of the air. In contrast, the user of a slide trombone varies the tube length thereof and the resulting sound pitch by selectively telescoping the trombone slide which is slidably mounted on a plurality of stationary fixed lengths of tubing, known as receivers, as hereinafter described.

The conventional trombone has a mouthpiece mounted on a fixed length of straight tubing. The trombone also includes a bell from which sound eminates when the instrument is played. A second fixed length of straight tubing is coupled on one end thereof through a U-shaped section of tubing to the bell. A thin, usually cylindrical connector bar physically joins the mouthpiece to the bell portion thereby configuring the two fixed lengths of straight tubing in a substantially parallel relationship. The free end of each of the fixed lengths of tubing, or receivers, terminate in a raised angular section or lip called a "stocking". A U-shaped section of tubing forming a "slide" provides two leg portions each having an inner diameter slightly greater than the outer diameter of the stockings of the fixed length straight members of tubing. The slide is slidably mounted on the two fixed length straight tube members by slipping of the slide legs over the inner tube stockings. Grease or cream is applied to the stockings before the instrument is played and therefore the slide rides freely along the inner tube members thereby varying the length of the tubing through which air travels between the mouthpiece and the bell of the trombone. Extending the tube length of the instument by a slide rather than by valves permits a more continuous, rather than discrete, change in pitch which provides a sound unique to the trombone as compared to other wind instruments.

Unfortunately, the length of tubing required to fabricate a trombone slide which can produce the desired range in pitch is great and the slide, especially in its fully extended or seventh position, makes the slide trombone somewhat difficult to play where space is at a premium. In addition, some musicians with relatively short arms, such as children, are often unable to play the slide trombone because they cannot reach the most extended slide positions. Further, when the slide is in the seventh position, nearly all of the weight thereof is transferred as torque to the two stockings and the associated receiver tube members, resulting in sluggish slide movement.

In attempts to overcome the inherent disadvantages of the conventional slide trombone, various inventors have attempted to reconfigure the slide. In U.S. Pat. No. 673,983 issued to Harrison on May 14, 1901 and U.S. Pat. No. 2,093,993 issued Adriani on Sept. 28, 1937, the providing of two connected U-shaped slides, instead of the typical one, is suggested. Adriani shows a trombone wherein air passes from a mouthpiece through a first U-shaped slide element in a selected plane, into a return bend means, and then into a second U-shaped slide element, in the same plane, the output from the second U-shaped slide element entering a bell portion. The two U-shaped slide elements are connected together such that both elements slide as a single slide element. While shortening the length of the instrument by essentially looping back the slide, this double slide arrangement introduces a serious pitch problem. Similarly, Harrison teaches a trombone essentially the same as Adriani with the two U-shaped slides being adjacently disposed in parallel planes, this configuration also resulting in a pitch problem.

Specifically, these, as well as other slide trombones or such similar slide instruments are made up of two types of tubing: fixed and expandable. The bell portion and the mouthpiece portion are essentially fixed lengths of tubing. In Adriani and Harrison, several relatively lengthy bent sections are employed which also represent fixed lengths of tubing. In addition, the fixed length straight inner tube members on which the slide elements ride are also of a fixed length. The portion of the slide which extends beyond the fixed length inner tube members represents the expandable portion of the tubing. Where it is desirable to achieve the same sound output from a double slide trombone as is achievable from a conventional slide trombone, it is vital that the length and ratios of the fixed tubing to expandable tubing remain unchanged. An examination of Harrison and Adriani suggest that these prior art configurations create a problem in this regard. Harrison includes several large bends which increase the amount of fixed length tubing in the trombone by several inches. Similarly, Adriani provides bends or crooks which similarly greatly increase the amount of fixed instrument tubing length when compared to the conventional single slide trombone.

Based on the prior art, if a double slide trombone is to produce the same pitch output as a conventional single slide trombone in the closed or first position, either (1) the length of the bell portion can be shortened in order to accommodate the addition length resulting from the return bends or crooks or (2) the length of the double slide and the inner tube members on which it travels can be shortened to achieve the first position. However, shortening the length of the double slide and the inner tube members results in an undesirable shortening of the expandable portion of the tubing to a length less than that of the conventional trombone; the seventh or fully extended position and associated pitch thus become unattainable. The increase in fixed tubing in the double slide configurations of Harrison and Adriani thus create a dilemma wherein either the bell portion must be specially designed for the double slide instrument or the first position or the seventh position and their associated pitches become unattainable.

Adriani also teaches a trombone embodiment which is a radical departure from a conventional trombone configuration. Specifically, Adriani proposes a trombone in the embodiment illustrated in FIG. 1 thereof which does not necessarily suffer from the aforementioned pitch problem, but which substitutes for the pitch problem an extremely awkward configuration. In this configuration, all of the receivers and all of the tubes which make up the slide portions of the trombone are disposed in the same horizontal plane when the instrument is played. This creates a tremendously awkward instrument which does not play like a conventional trombone, which creates numerous unacceptable moments of force, and which is virtually impossible to properly grip. Specifically, because the crook interposed between the two slide elements of this configuration is small as a result of the end crooks of the slide portions being of an arbitrary arcuate diameter, the conventional area in which a slide is grabbed in this configuration will not accommodate a human hand. Additionally, use of this planar slide of Adriani will not properly train a musician so that he can quickly transfer to a conventional trombone when the need arises.

Since, as a practical consideration, it is desirable to utilize a conventional bell and to retrofit a slide thereto to produce an instrument capable of the conventional pitch range, the inventions taught by Harrison and Adriani can be seen not to achieve such an end. In the one configuration proposed by Adriani which may solve the pitch problem, it is done in a manner which provides a trombone that most trombone players would consider unplayable because of its extremely awkward configuration.

Thus, while recognizing a specific need in the music field, the prior art instruments do not overcome the problems associated with double slide configurations.

SUMMARY OF THE INVENTION

The present invention resolves the fixed length versus expandable length dilemma of the prior art by minimizing the tube length of the required bends or crooks which can add fixed length tubing at the the expense of expandable length tubing.

Additionally, the present invention resolves this problem and provides a trombone configuration which has a slide that plays and can be held in exactly the same manner as a conventional trombone.

Specifically, a trombone slide constructed according to the principles of the present invention comprises two U-shaped slide tube members wherein the tubes thereof are directly adjacent to each other so that the crook at the base of each member has a minimum arcuate length. Accordingly, the forward tubing of the slide is placed proximate to or in direct contact with the return tubing of the slide, the forward tubing and the return tubing, respectively, carrying air moving in the forward and return directions when the instrument is in use. As a result, the length of the crooks in each U-shaped slide tube element is reduced to a minimum, thereby minimizing any additional fixed length previously added to the total instrument tube length by the providing of a double slide arrangement.

In accordance with the present invention, characterized by the inventor as a quadro slide, the two U-shaped slide tube members with minimal length crooks slide along four inner tube members or receivers. As in a conventional slide, the quadro slide rides on stockings located at the end of each inner tube member. Because there are four stockings in the present invention, instead of just two in a conventional trombone, less weight is borne by each stocking and slide movement is less sluggish. As in the case of the conventional trombones, the stockings are lubricated to facilitate slide movement.

As a result of employment of the quadro slide, both the length of the instrument during play and the distance between the various slide positions are shortened. Therefore, extending the slide to the seventh position does not require as great a reach as with a conventional trombone. In addition, the end of the slide does not protrude as far with the present invention as with the conventional trombone, thereby achieving the object of lessening the required playing area for the instrument, a characteristic helpful, for instance, in marching bands.

With the present invention, the seven positions of a conventional trombone can be effected without any modification to the conventional bell portion of the instrument.

To provide a playable configuration, the receiver tubes are grouped in first and second pairs, disposed in spaced apart parallel planes. The complementary slide tube members which mount on the receivers are also disposed in complementary spaced apart planes, the receivers and slide elements being spaced apart in a substantially vertical plane, with the pairs of receivers and slide elements being disposed in substantially horizontal planes when the instrument is in a use position.

In accordance with the present invention, the quadro slide is interchangeable with other slides of various lengths. Thus, with a single, conventional bell and mouthpiece arrangement, a tenor, bass, or even a contrabass trombone may be formed by simply increasing the length of the quadro slide.

Finally, to support the various lengths of tubing, special braces are provided. Also, to permit the elimination of water in the tube, a unique water key is provided for the quadro slide.

It should be noted that the invention also contemplates a slide comprising more than two U-shaped slide tube members, such an embodiment being with the teachings thereof. In such embodiments having three or more U-shaped slide tube members, the crooks would again be of minimal arcuate length.

Therefore, a primary object of the present invention is to provide a trombone with a compact slide portion.

A further object of the present invention is to provide a trombone with a compact slide that has a conventionally dimensioned bell.

A still further object of the present invention is to provide a trombone with a compact slide that operates in a conventional pitch range.

An additional object of the present invention is to provide a trombone slide configuration that can be readily retrofitted to a conventional bell.

A still additional object of the present invention is to provide a wind instrument having a compact slide configuration which is simple in design, relatively inexpensive to manufacture, durable, and readily serviceable.

These objects, as well as further objects and advantages of the present invention, will become readily apparent after reading the ensuing description of the nonlimiting illustrative embodiments and viewing the accompanying drawings.

BRIEF DESCRIPTION OF THE DRAWING

In order that the present invention may be more fully understood, it will now be described, by way of example, with reference to the accompanying drawings in which.

DESCRIPTION OF THE PREFERRED EMBODIMENTS

Figure 1:
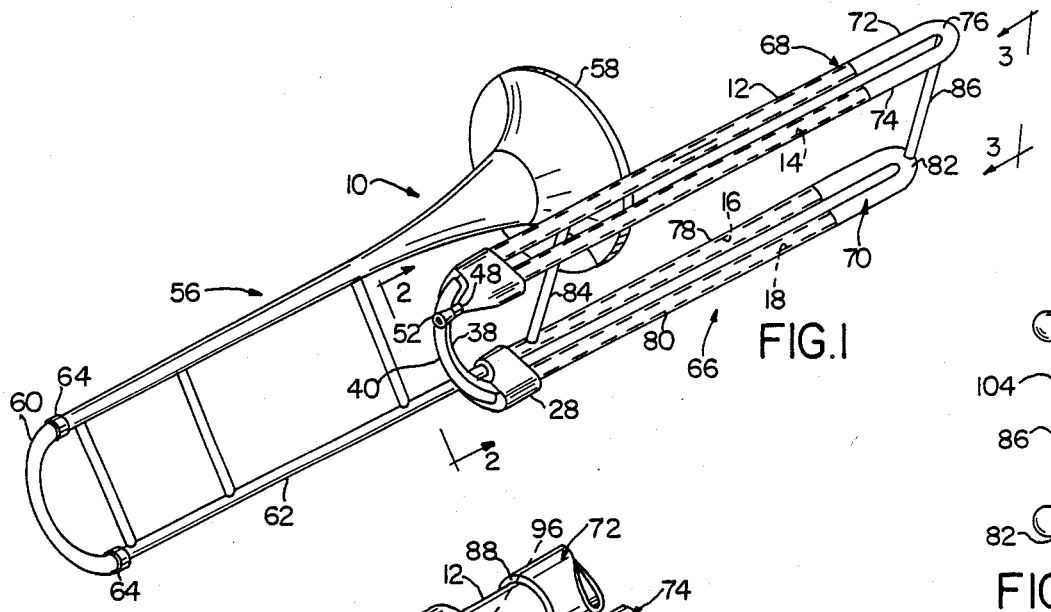
FIG. 1 shows a perspective view of a first embodiment of a musical instrument incorporating the quadro slide of the present invention.
Figure 3:
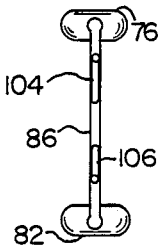
FIG. 3 is an end view of the instrument of FIG. 2 taken substantially from the lines 3—3 of FIG. 1.
Figure 4:
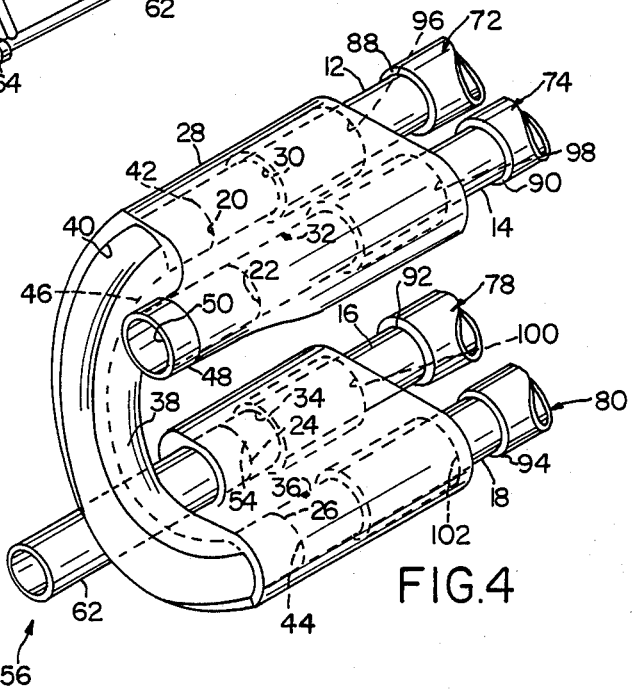
FIG. 4 is an enlarged fragmentary view in perspective of the handle portion of the present invention.

Referring now to the figures, and more particularly to FIGS. 1 and 4 thereof, there is illustrated therein a slide instrument 10. The slide instrument 10 includes a first pair of receiver tubes 12 and 14 which are mounted in a first plane. Directly below the first pair of receiver tubes 12 and 14 is a second pair of receiver tubes 16 and 18 mounted in a second plane, the second plane being substantially parallel to the first plane. The ends 20, 22, 24, and 26, respectively, of the first and second pairs of receiver tubes 12, 14, 16, and 18 are all disposed within and are mounted by a handle grip 28. The handle grip 28 mounts the receiving tubes 12, 14, 16, and 18 in a fixed positional relationship in the aforementioned first and second planes. The handle grip 28 is of unitary construction and includes a plurality of apertures 30, 32, 34, and 36 the longitudinal axes of which are all substantially parallel, and which receive therein and mount, respectively, the receiving tubes 12, 14, 16, and 18. The handle grip 28 includes a hand engagement portion 38 which is gripped by the user during use. The hand engagement portion 38 can be suitably taper as desired and may include ridges or other undulations to facilitate the grasping thereof by a musician. The handle grip 28 is preferably cast from a suitable material which will provide the necessary rigidity as well as durability.

The first end 20 of the receiver tube 12 is put in communication with the first end 26 of the receiver 18 by a U-shaped section of tubing 40. The U-shaped section of tubing 40 is affixed on its ends 42 and 44 thereof, respectively, to the ends 20 and 26 of the receiver tubes 12 and 18 in any suitable manner and, if desired, the U-shaped section of tubing 40 may be integrally formed with the receiver tubes 12 and 18. A recess 46 is formed in the handle grip and is shaped to accommodate therein the U-shaped section of tubing 40. This adds to the rigidity and stability of the positional relationship between the receiving tubes 12, 14, 16, and 18. A mouthpiece receiver 48 is fixedly secured to the end 22 of the receiver tube 14 and is adapted to receive in the mouth 50 thereof a mouthpiece 52 as illustrated in FIG. 1.

The end 24 of the receiver tube 16 is fixedly secured to an end 54 of a bell portion 56. The bell portion 56 has a bell 58, U-shaped tubing 60 which decreases in diameter back from the bell 58, and straight section of tubing 62 which terminates at end 54. The end 54 of the bell portion 56 is connected to the end 24 of the receiver 16 in any suitable manner. The U-shaped tubing 60 comprises a tuning slide having conventional slip joints 64. Through use of the U-shaped tubing 60 forming the tuning slide, when the present invention is used with a conventional bell, a trombone which can get to E flat is provided.

The slide assembly 66 of the present invention includes a pair of substantially U-shaped slide tube members 68 and 70. The U-shaped slide tube member 68 includes legs 72 and 74 which are joined together by a substantially U-shaped crook 76. The U-shaped slide tube member 70 includes a leg 78 and a leg 80 joined together by a substantially U-shaped crook 82. The legs 72 and 74 of the U-shaped slide tube member 68 are in close proximity to each other and may be in contact. The legs 78 and 80 of the U-shaped slide tube member 70 are similarly disposed, the crooks 76 and 82 being of minimum arcuate length. The U-shaped slide tube members 68 and 70 are joined together by two cross pieces or braces 84 and 86. The braces 84 and 86 may be variously configured and serve to fix the U-shaped slide tube members 68 and 70 in substantially parallel planes. Therefore, when the slide assembly 66, dubbed by the inventor to be a quadro slide, is disposed on the receiver tubes 12, 14, 16, and 18 a unitary structure which can slide back and forth thereon is provided. The brace 84 is grasped by the musician to move the quadro slide assembly 66 back and forth on the receiver tubes 12, 14, 16, and 18. The ends 88, 90, 92, and 94, respectively, of the legs 72, 74, 78, and 80 are permitted to recede into enlarged apertures 96, 98, 100, and 102 which are disposed in the handle grip 28. This in effect creates what is generally known as a disappearing slide.

With the invention configured as aforedescribed, the instrument tube length in the first or shorter of the slide positions available when the quadro slide assembly 66 is closest to the musician is approximately one hundred and ten inches and the instrument tube length in the seventh or largest of the slide positions is approximately one hundred and seventy-three inches, these dimensions being the same as a conventional trombone, the intermediate positions of the quadro slide assembly 66 also being conventional.

Figure 2:
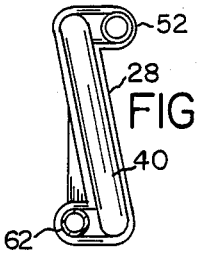
FIG. 2 is a cross sectional view of the instrument shown in FIG. 1 taken along the lines 2—2 thereof.

Referring now specifically to FIG. 2, the disposition of the U-shaped section of tubing 40 in the handle grip 28 can more clearly be seen. Of course, if desired, the handle grip can be fixedly secured to the U-shaped section of tubing 40 and/or the receiver tubes 12, 14, 16, and 18 as desired. With reference to FIGS. 1, 2, and 4, it can be seen that when the instrument 10 is in use, air from the mouthpiece 52 enters the interior or the receiver tube 14. From there, the air enters the interior of the receiver tube 12 via the U-shaped slide tube member 68. The air then travels through the interior of the receiver tube 12, down through the interior of the U-shaped section of tubing 40 and through the interior of the receiver tube 18. Air then travels through the U-shaped slide tube member 70 and into the interior of the straight section of tubing 62 of the bell portion 56. The air then travels through the interior of the U-shaped tubing 60 and out through the bell 58.

To aid in the release of moisture built up within the U-shaped slide tube members 68 and 70, a pair of water keys 104 and 106, of conventional spring urged pivotal design, are mounted on the brace 86 and cover apertures, not illustrated, which permit the draining of water from the quadro slide assembly 66.

As a result of the aforedescribed construction, the slide instrument 10 closely approximates the feel of a conventional trombone, yet provides a slide assembly which is half the length of a conventional slide assembly. The plane in which the bell resides is at the same relative angle to the plane in which the slide resides and therefore no awkward configuration is presented. Additionally, the U-shaped section of tubing 40 is essentially the same radius of curvature as a conventional trombone and therefore a familiar grip is afforded a musician. The comfortable nature of the invention and the fact that it is capable of producing a conventional pitch range is in part attributed to the novel placement of the U-shaped slide tube members 68 and 70 and the associated receiver tubes 12, 14, 16, and 18 so that they move in the aforementioned first and second parallel planes, these planes being substantially horizontal when the instrument is in use.

Figure 6:
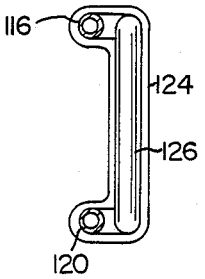
FIG. 6 is a cross sectional view of the instrument shown in FIG. 5 taken substantially from the lines 6—6 thereof.
Figure 5:
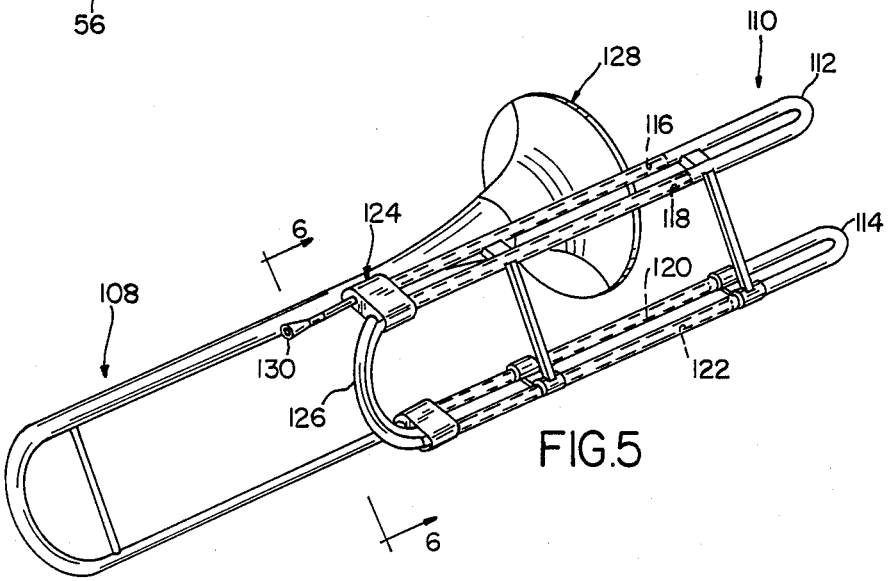
FIG. 5 is a perspective view of another embodiment of the present invention.

Referring now to FIGS. 5 and 6, an alternately structured instrument 108 is illustrated incorporating a quadro slide 110 constructed in accordance with the principles of the present invention. The quadro slide 110 includes a pair of U-shaped slide tube members 112 and 114 that fall in substantially parallel spaced apart planes.

The instrument 108 includes receiver tubes 116, 118, 120, and 122 on which the quadro slide 10 reciprocates. The receiver tubes 116, 118, 120, and 122 are mounted in a fixed positional relationship by a handle grip 124. The difference between this embodiment and that shown in FIGS. 1 through 4 is that the U-shaped section of tubing 126 connects together receiver tubes 118 and 122 and therefore is disposed in a substantially vertical position as illustrated in FIG. 6. This is in contrast to the diagonal configuration of the U-shaped section of tubing 40 as illustrated in FIG. 2.

The instrument 108 further includes a bell portion 128 and a mouthpiece 130 identical in function to the bell portion 56 and the mouthpiece 52 of the embodiment of FIGS. 1 through 4. When this embodiment is in use, air flows from the mouthpiece 130 through the receiver tube 116 and into the U-shaped slide tube member 112. From the U-shaped slide tube member 112 air flows through receiver tube 118 and then through U-shaped section of tubing 126 to receiver tube 122. The air then proceeds through slide tube member 114 and through the interior of receiver tube 120 so that it can pass through the bell portion 128.

Figure 7:
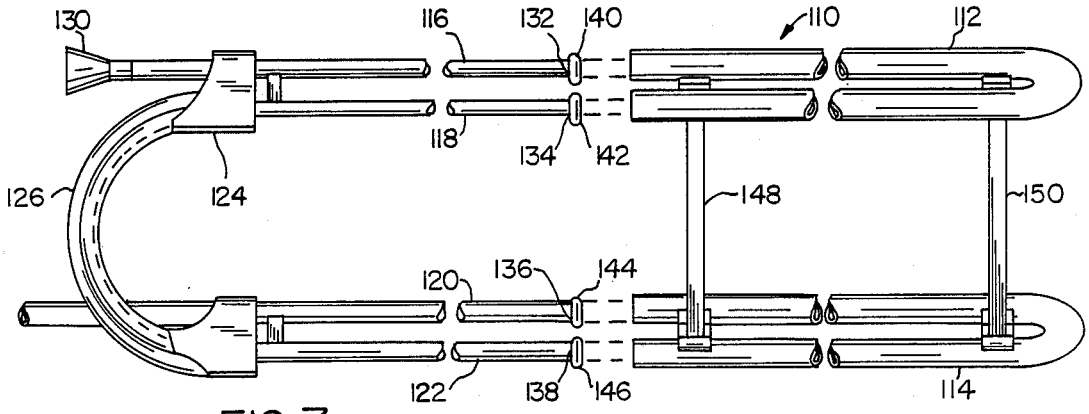
FIG. 7 is a fragmentary view in perspective of the embodiment of the present invention shown in FIGS. 5 and 6 wherein the slide is shown withdrawn from around the receivers of the instrument.

With reference to FIG. 7, it can be seen that the free ends 132, 134, 136, and 138, respectively, if the receiver tubes 116, 118, 120, and 122 are provided with, respectively, stockings 140, 142, 144, and 146. The stockings 140 through 146 are dimensioned to be received within the interior of the legs of the slide tube members 112 and 114. The receiver tubes 12, 14, 16, and 18 of the slide instrument 10 are preferably similarly equipped, this construction being well known in the trombone art. The stocking 140, 142, 144, and 146 are greased so that they can slide easily within the quadro slide 110. The slide tube members 112 and 114 are secured together by a pair of supports 148 and 150 which are differently configured than the supports illustrated in conjunction with slide instrument 10, but which perform the same function. Although the construction details of the quadro slide 110, as illustrated in FIGS. 5 through 7 are discussed in conjunction with that embodiment, they are equally applicable in principle to the embodiment of the present invention illustrated in FIGS. 1 through 4.

When the slide instruments 10 and 108 are used to create music, by changing the position of the quadro slide assemblies thereof, the pitch of the instrument can be varied accordingly. As previously discussed in conjunction with FIGS. 1 through 4, when the quadro slides are in their closed position (covering or overlapping the lengths of the receiver tube members), the instrument tube length of the trombones essentially matches that of a conventional trombone, namely one hundred and ten inches. Further, when the quadro slides are at their fully extended position, the total instrument tube length of the present invention will again match that of the conventional tenor trombone, namely approximately one hundred and seventy-three inches. Thus, in either embodiment, a normal slide trombone is matched in pitch range, yet an extremely compact configuration is provided.

Of course, varying the tube length of the quadro slide can vary the pitch of an instrument, changing them from a tenor trombone to a bass or contrabass trombone. Accordingly, the quadro slides can easily be replaced or interchanged with another quadro slide of different length. In this regard, it should be noted that the longer the tube, the lesser will be the effects of any additional length which might result from the adding of crook elements in a double slide arrangement. Further, by extending the lengths of the inner tube members and the length of the quadro slides more than seven half tone positions may be reached. Although the invention allows for this flexibility and it is recognized by the inventor, the primary goal of the invention is to produce a compact trombone which plays as a conventional trombone, the creation of differently functioning instruments being recognized.

Figure 8:
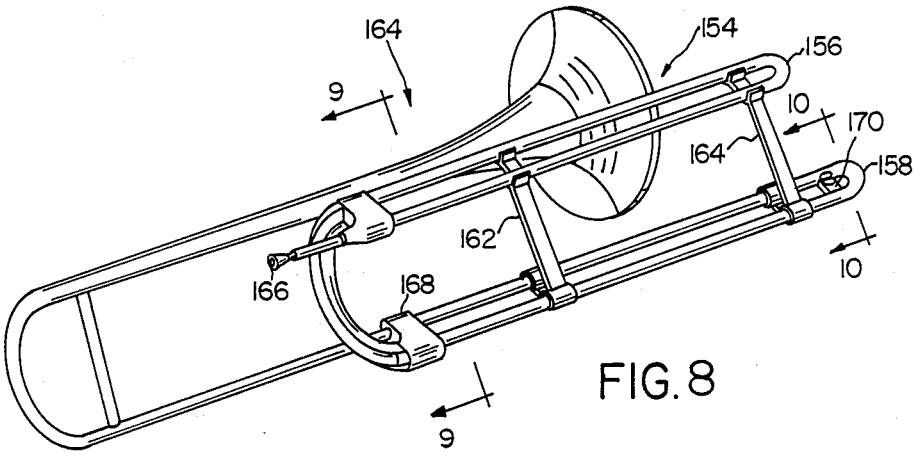
FIG. 8 illustrates a perspective view of an embodiment of the present invention incorporating particular brace elements at the front end and on the slide of the instrument.
Figure 10:
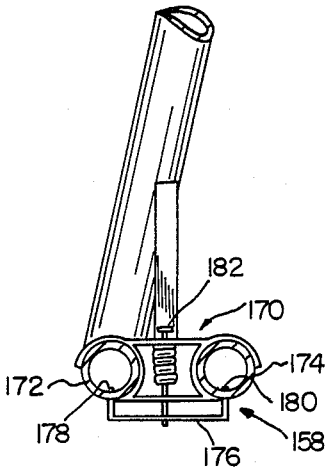
FIG. 10 is a fragmentary cross sectional view of the double water key connected to the brace of the instrument shown in FIG. 8, taken along the lines 8—8 thereof.

FIG. 8 illustrates a slide instrument 152 having a quadro slide assembly 154 including U-shaped slide tube members 156 and 158. The slide tube members are mounted together by a pair of braces 162 and 164. The instrument 154 also includes a bell portion 164, a mouthpiece 166, and a handle grip 168. The instrument 154 is essentially configured the same as the instrument 10 of FIG. 1, with a difference being provided in the braces or supports that join the U-shaped slide tube members of the slide assembly together. Additionally, with specific reference to FIG. 10, it can be seen that the instrument 154 incorporates a dual water key assembly 170. The dual water key assembly is mounted on the legs 172 and 174 of the U-shaped slide tube assembly 158 and provides a spring loaded key 176 that is adapted to close a pair of apertures, 178 and 180 disposed, respectively, in the legs 172 and 174. The spring loaded water key assembly 170 opens the apertures 178 and 180 by pushing of a button 182.

Figure 9:
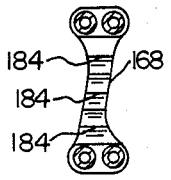
FIG. 9 is an isolated pictorial representation of the handle brace also shown in FIG. 8.

FIG. 9 illustrates a view of the handle grip 168 showing the contour of the hand section thereof and a plurality of ridges 184 which are provided to aid the musician in the grasping thereof. This view of the hand grip 168 is essentially what the hand grip 28 would look like if viewed from a similar angle. The hand grips 28 and 168 are essential in the mounting of their respective receiver tubes, since, unless exacting alignment of the receiver tubes is effected, the quadro slides will not freely reciprocate thereon and will bind.

Because the quadro slide of the present invention is the same length as a conventional slide and is configured in a compact configuration, it is suited for retrofitting on a conventional bell of a trombone so that an instrument which permits pitch ranges exactly the same as a conventional trombone can be created. Such retrofitting can be easily accomplished at a minimal cost. Since, through the arrangement of the receiver tubes and therefore the U-shaped slide members of the present invention in spaced apart substantially parallel planes which are in a generally horizontal position when the instrument of the present invention is played, an individual who is trained on such an instrument will have no problem switching to a conventional trombone as the need or desire arises. This is in contradistinction to the prior art since compact trombones which function in the correct tonal range have had awkward if not unusable configurations.

It should be noted that the presented invention is directed primarily to slide trombones of the tenor, bass, or contrabass variety. The invention also extends to any other brass wind instrument which extends the length of its tubing size by means of a slide. In this regard, it should be noted that the term brass does not suggest any limitation as to material of which the instrument is made, but rather conforms to the standard musical instrument classification. For instance, the present invention thus extends to instruments which might be constructed of fiberglass as well as metals other than brass.

It should be understood that various changes in the details, materials, and arrangement of parts, and operational conditions which have been herein described and illustrated in order to explain the nature of the invention, may be made by those skilled in the art within the principles and scope of the invention.

Having thus set forth the nature of the invention, what is claimed is:

1. A brass wind instrument which changes pitch by varying the tube length comprising:

a first pair of receiver tubes disposed proximate to each other in a first plane, each of said tubes of said first pair having a first end and a second end;

a second pair of receiver tubes disposed proximate to each other in a second plane, said second plane being spaced apart and substantially parallel to said first plane, each of said tubes of said second pair having a first end and a second end, said first pair of receiver tubes being closer to each other than to said second pair of receiver tubes, said second pair of receiver tubes being closer to each other than to said first pair of receiver tubes;

means for coupling the first end of one of said receiver tubes of said first pair to the first end of one of said receiver tubes of said second pair;

a bell for affixment to the first end of the other of said receiver tubes of said first pair;

a mouthpiece for affixment to the first end of the other of said receiver tubes of said second pair; and a slide assembly including a pair of substantially U-shaped slide tube members, each of said slide tube members having a pair of adjacent legs joined on one end thereof by a crook, the other end of each of said legs of each of said slide tube members dimensioned for slidably engaging one of said receiver tubes, one of said slide tube members for engaging said second ends of said first pair of receiver tubes, the other of said slide tube members for engaging said second ends of said second pair of receiver tubes, said slide tube members being joined together for simultaneous movement, each of said substantially U-shaped slide tube members being configured so that said adjacent legs of each of the respective said pairs of adjacent legs are closer together than said substantially U-shaped slide tube members are to each other when in position on said first and second pairs of receiver tubes.

2. An instrument in accordance with claim 1, further comprising mounting means for rigidly mounting the first ends of each of said receiver tubes of said first and second pairs in a fixed positional relationship.

3. An instrument in accordance with claim 2, wherein said mounting means comprises a handle grip having a plurality of apertures disposed therethrough for receiving therein a portion of each of said receiving tubes adjacent to the first ends thereof.

4. An instrument in accordance with claim 3, wherein said coupling means comprises a connecting crook of tubing, said handle grip having disposed therein a recess for receiving said connecting crook.

5. An instrument in accordance with claim 4, wherein said handle grip is contoured to facilitate gripping by the user.

6. An instrument in accordance with claim 4, wherein said handle grip comprises a casting.

7. An instrument in accordance with claim 4, wherein said handle grip is substantially U-shaped and conforms in shape to said connecting crook.

8. An instrument in accordance with claim 1, wherein said bell further comprises an adjustable tuning slide.

9. An instrument in accordance with claim 1, wherein said coupling means is in a plane substantially diagonally disposed relative to said first and second planes.

10. An instrument in accordance with claim 1, wherein said coupling means is in a plane substantially perpendicular to said first and said second planes.

11. An instrument in accordance with claim 1, wherein said pair of substantially U-shaped slide tube members are joined together by at least one brace.

12. An instrument in accordance with claim 1, wherein said bell is of a conventional length.

13. An instrument in accordance with claim 12, wherein said U-shaped slide tube members can be slidably positioned along the first and second pairs of receiver tube members in any of at least seven positions corresponding to seven half-tone pitch positions.

14. An instrument in accordance with claim 13, wherein the instrument tube length in the first or shorter of said positions is approximately one hundred and ten inches and the instrument tube length in the seventh or longest of said positions is approximately one hundred and seventy-three inches.

15. An instrument in accordance with claim 1, further comprising an aperture disposed in each of said crooks of said slide tube members, and a pair of water keys, each of said water keys for selectively covering one of said apertures.

16. An instrument in accordance with claim 15, wherein said pair of substantially U-shaped slide tube members are joined together by at least one brace, said water keys being mounted on said brace.

17. An instrument in accordance with claim 1, wherein said crooks of said U-shaped slide tube members are of the minimum arcuate length possible which still permits substantially unimpeded air flow:

18. A trombone slide for use in conjunction with a conventional trombone bell and mouthpiece comprising:

a first pair of receiver tubes disposed proximate to each other in a first plane, each of said tubes of said first pair having a first end and a second end;

a second pair of receiver tubes disposed proximate to each other in a second plane, said second plane being spaced apart and substantially parallel to said first plane, each of said tubes of said second pair having a first end and a second end, said first pair of receiver tubes being closer to each other than to said second pair of receiver tubes, said second pair of receiver tubes being closer to each other than to said first pair of receiver tubes;

means for coupling the first end of one of said receiver tubes of said first pair to the first end of one of said receiver tubes of said second pair, the first end of the other of said receiver tubes of said first pair adapted to be affixed to said bell, the first end of the other of said receiver tubes of said pair adapted to be affixed to said mouthpiece; and a slide assembly including a pair of substantially U-shaped slide tube members, and of said slide tube members having a pair of adjacent legs joined on one end thereof by a crook, the other end of each of said legs of each of said slide tubes dimensioned for slidably engaging one of said slide tubes dimensioned for slidable engaging one of said receiver tubes, one of said slide tube members for engaging said second ends of said first pair of receiver tubes, the other of said slide tube member for engaging said second ends of said second pair of receiver tubes, said slide tube members being joined together for simultaneous movement, each of said substantially U-shaped slide tube members being configured so that said adjacent legs of each of the respective said pairs of adjacent legs are closer together than said substantially U-shaped slide tube members are to each other when in position on said first and second pairs of receiver tubes, the spatial relationships between said first and second receiver tubes and said pair of substantially U-shaped slide tube members providing an air passage between said conventional bell and mouthpiece of a length equal to that of a conventional trombone.

19. A slide in accordance with claim 18, further comprising mounting means for rigidly mounting the first ends of said receiver tubes of said first and second pairs in a fixed positional relationship.

20. A slide in accordance with claim 19, wherein said mounting means comprises a handle grip having a plurality of apertures disposed therethrough for receiving therein a portion of each of said receiving tubes adjacent to the first ends thereof.

21. A slide in accordance with claim 20, wherein said coupling means comprises a connecting crook of tubing, said handle grip having disposed therein a recess for receiving tubes adjacent to the first ends thereof.

22. A slide in accordance with claim 21, wherein said handle grip is contoured to facilitate gripping by the 23. A slide in accordance with claim 21, wherein said handle grip comprises a casting.

24. A slide in accordance with claim 21, wherein said handle grip is substantially U-shaped and conforms in shape to said connecting crook.

25. A slide in accordance with claim 18, wherein said bell further comprises an adjustable tuning slide.

26. A slide in accordance with claim 18, wherein said coupling means is in a plane substantially diagonally disposed relative to said first and second planes.

27. A slide in accordance with claim 18, wherein said coupling means is in a plane substantially perpendicular to said first and said second planes.

28. A slide in accordance with claim 18, wherein said pair of substantially U-shaped slide tube members are joined together by at least one brace.

29. A slide in accordance with claim 18, wherein said bell is of a conventional length.

30. A slide in accordance with claim 29, wherein said U-shaped slide tube members can be slidably positioned along the first and second pairs of receiver tube members in any of at least seven positions corresponding to seven half-tone pitch positions.

31. A slide in accordance with claim 30, wherein the instrument tube length in the first or shortest of said positions is approximately one hundred and ten inches and the instrument tube length in the seventh or longest of said positions is approximately one hundred and seventy-three inches.

32. A slide in accordance with claim 18, further comprising an aperture disposed in each of said crooks of said slide tube members, and a pair of water keys, each of said water keys for selectively covering one of said apertures.

33. A slide in accordance with claim 32, wherein said pair of substantially U-shaped slide tube members are joined together by at least one brace, said water keys being mounted on said brace.

34. A slide in accordance with claim 18, wherein said crooks of said U-shaped slide tube members are of the minimum arcuate length possible which still permits substantially unimpeded in flow.

* * * * *